US010869586B2

(12) United States Patent
Bearup et al.

(10) Patent No.: US 10,869,586 B2
(45) Date of Patent: Dec. 22, 2020

(54) PORTABLE VACUUM AND RELATED ACCESSORIES

(71) Applicant: Kärcher North America, Inc., Denver, CO (US)

(72) Inventors: Adam Bearup, Lakewood, CO (US); Manuel Schulze, Aurora, CO (US); Sheri Huther, Westminster, CO (US); Jonathan Guilford, Denver, CO (US)

(73) Assignee: KARCHER NORTH AMERICA, INC., Denver, CO (US)

( * ) Notice: Subject to any disclaimer, the term of this patent is extended or adjusted under 35 U.S.C. 154(b) by 319 days.

(21) Appl. No.: 15/816,547

(22) Filed: Nov. 17, 2017

(65) Prior Publication Data

US 2018/0132682 A1 May 17, 2018

Related U.S. Application Data

(60) Provisional application No. 62/423,661, filed on Nov. 17, 2016.

(51) Int. Cl.

| | |
|---|---|
| ***A47L 7/00*** | (2006.01) |
| ***A47L 5/26*** | (2006.01) |
| ***A47L 9/00*** | (2006.01) |
| ***A47L 9/32*** | (2006.01) |
| ***A47L 9/24*** | (2006.01) |
| ***A47L 5/36*** | (2006.01) |

(52) U.S. Cl.

CPC ..... *A47L 7/0014* (2013.01); *A47L 5/365* (2013.01); *A47L 7/0019* (2013.01); *A47L 9/009* (2013.01); *A47L 9/0027* (2013.01); *A47L 9/0036* (2013.01); *A47L 9/0045* (2013.01); *A47L 9/244* (2013.01); *A47L 9/325* (2013.01)

(58) Field of Classification Search

CPC ..... A47L 7/0014; A47L 9/244; A47L 9/0027; A47L 9/0045; A47L 9/0036; A47L 5/365; A47L 9/009; A47L 9/325; A47L 7/0019

See application file for complete search history.

(56) References Cited

U.S. PATENT DOCUMENTS

| | | | |
|---|---|---|---|
| 3,584,539 | A | 6/1971 | Sugden, Jr. |
| 4,330,899 | A | 5/1982 | Miller et al. |
| D276,279 | S | 11/1984 | Miller et al. |
| D280,143 | S | 8/1985 | Berfield et al. |
| D286,336 | S | 10/1986 | Berfield et al. |
| D287,171 | S | 12/1986 | Berfield et al. |
| D287,658 | S | 1/1987 | Berfield et al. |
| D287,895 | S | 1/1987 | Berfield et al. |
| D294,413 | S | 2/1988 | Berfield et al. |

(Continued)

FOREIGN PATENT DOCUMENTS

| | | |
|---|---|---|
| AU | 740214 B2 | 11/2001 |
| AU | 2015101867 A4 | 7/2016 |

(Continued)

*Primary Examiner* — David Redding

(74) *Attorney, Agent, or Firm* — Sheridan Ross P.C.

(57) ABSTRACT

An improved wet/dry vacuum device is provided. The device comprises features for enhancing the portability, mobility and usefulness of existing wet/dry vacuums and canister vacuum devices. Features of devices of the present disclosure include, but are not limited to, hose storage features, accessory storage features, and power cord management features.

17 Claims, 8 Drawing Sheets

(56) References Cited

U.S. PATENT DOCUMENTS

| | | | |
|---|---|---|---|
| D294,414 | S | 2/1988 | Berfield et al. |
| D294,879 | S | 3/1988 | Berfield et al. |
| 4,747,179 | A | 5/1988 | Berfield |
| 4,797,072 | A | 1/1989 | Berfield et al. |
| D305,167 | S | 12/1989 | Case et al. |
| D311,615 | S | 10/1990 | Berfield et al. |
| D311,797 | S | 10/1990 | Hult et al. |
| D315,235 | S | 3/1991 | Berfield et al. |
| D344,616 | S | 2/1994 | Berfield et al. |
| D358,010 | S | 5/1995 | Berfield et al. |
| D362,091 | S | 9/1995 | Tomasiak et al. |
| D364,524 | S | 11/1995 | Bassler et al. |
| D370,097 | S | 5/1996 | Griffin et al. |
| 5,548,868 | A | 8/1996 | Berfield et al. |
| D374,523 | S | 10/1996 | Tomasiak |
| 5,598,605 | A | 2/1997 | Tomasiak |
| 5,600,866 | A | 2/1997 | Berfield |
| 5,611,107 | A | 3/1997 | Tomasiak et al. |
| 5,638,575 | A | 6/1997 | Sin |
| 5,647,570 | A | 7/1997 | Berfield et al. |
| D383,575 | S | 9/1997 | Griffin |
| D389,962 | S | 1/1998 | Berfield et al. |
| 5,704,090 | A | 1/1998 | Berfield |
| 5,706,550 | A | 1/1998 | Holsten et al. |
| 5,715,568 | A | 2/1998 | Berfield et al. |
| D392,780 | S | 3/1998 | Holsten et al. |
| 5,733,351 | A | 3/1998 | Hult et al. |
| 5,747,973 | A | 5/1998 | Robitaille et al. |
| 5,765,257 | A | 6/1998 | Steger et al. |
| 5,855,634 | A | 1/1999 | Berfield |
| 5,924,165 | A | 7/1999 | Gierer et al. |
| D417,534 | S | 12/1999 | Holston et al. |
| 5,996,170 | A | 12/1999 | Gierer et al. |
| 6,008,608 | A | 12/1999 | Holsten et al. |
| D418,643 | S | 1/2000 | Hoshino |
| 6,035,485 | A | 3/2000 | Holsten |
| 6,044,519 | A | 4/2000 | Hendrix |
| D424,766 | S | 5/2000 | Martin |
| 6,055,700 | A | 5/2000 | Holsten et al. |
| D426,359 | S | 6/2000 | Griffin et al. |
| D426,360 | S | 6/2000 | Griffin et al. |
| D426,687 | S | 6/2000 | Griffin et al. |
| 6,079,076 | A | 6/2000 | Berfield |
| D429,042 | S | 8/2000 | Griffin et al. |
| D429,394 | S | 8/2000 | Griffin et al. |
| D429,855 | S | 8/2000 | Griffin |
| D429,856 | S | 8/2000 | Griffin |
| D429,857 | S | 8/2000 | Griffin |
| 6,096,210 | A | 8/2000 | Hazrati et al. |
| 6,101,669 | A | 8/2000 | Martin et al. |
| 6,107,583 | A | 8/2000 | Berfield |
| 6,110,248 | A | 8/2000 | Liu |
| D430,713 | S | 9/2000 | Griffin |
| 6,112,366 | A | 9/2000 | Berfield |
| 6,113,663 | A | 9/2000 | Liu |
| 6,119,304 | A | 9/2000 | Berfield et al. |
| D434,537 | S | 11/2000 | Griffin et al. |
| 6,158,083 | A | 12/2000 | Holsten |
| D438,353 | S | 2/2001 | Hoshino et al. |
| D438,678 | S | 3/2001 | Griffin |
| D439,710 | S | 3/2001 | Griffin |
| 6,222,285 | B1 | 4/2001 | Haley et al. |
| 6,230,361 | B1 | 5/2001 | Griffin |
| 6,237,187 | B1 | 5/2001 | Hult et al. |
| D443,739 | S | 6/2001 | Young et al. |
| D444,276 | S | 6/2001 | Griffin |
| D445,548 | S | 7/2001 | Griffin |
| D445,549 | S | 7/2001 | Griffin |
| D446,892 | S | 8/2001 | Griffin |
| D447,292 | S | 8/2001 | Griffin |
| D447,293 | S | 8/2001 | Griffin |
| D447,609 | S | 9/2001 | Hult et al. |
| D447,842 | S | 9/2001 | Griffin |
| D447,843 | S | 9/2001 | Griffin |
| D447,844 | S | 9/2001 | Griffin |
| 6,309,469 | B2 | 10/2001 | Storrs et al. |
| 6,321,410 | B1 | 11/2001 | Holsten |
| D452,052 | S | 12/2001 | Griffin |
| 6,347,429 | B1 | 2/2002 | Hult et al. |
| D454,672 | S | 3/2002 | Griffin |
| 6,367,118 | B1 | 4/2002 | Berfield |
| 6,378,164 | B1 | 4/2002 | Berfield |
| 6,381,803 | B1 | 5/2002 | Berfield et al. |
| D460,230 | S | 7/2002 | Griffin |
| 6,440,227 | B1 | 8/2002 | Berfield et al. |
| 6,478,342 | B1 | 11/2002 | Berfield |
| 6,481,049 | B1 | 11/2002 | Berfield |
| 6,484,351 | B2 | 11/2002 | Griffin et al. |
| 6,485,259 | B2 | 11/2002 | Berfield |
| D466,659 | S | 12/2002 | Griffin |
| 6,494,544 | B1 | 12/2002 | Berfield et al. |
| 6,508,618 | B2 | 1/2003 | Berfield |
| 6,510,583 | B2 | 1/2003 | Griffin et al. |
| D469,934 | S | 2/2003 | Fry et al. |
| D470,279 | S | 2/2003 | Griffin et al. |
| D470,280 | S | 2/2003 | Griffin et al. |
| D470,281 | S | 2/2003 | Griffin et al. |
| 6,530,116 | B2 | 3/2003 | Berfield et al. |
| 6,543,085 | B2 | 4/2003 | Holsten et al. |
| 6,557,206 | B1 | 5/2003 | Liu |
| D479,023 | S | 8/2003 | Crevling |
| 6,610,952 | B2 | 8/2003 | Holsten et al. |
| D479,371 | S | 9/2003 | Griffin et al. |
| D479,372 | S | 9/2003 | Griffin |
| 6,637,068 | B2 | 10/2003 | Crevling, Jr. et al. |
| D486,280 | S | 2/2004 | Holsten et al. |
| 6,691,396 | B2 | 2/2004 | Martin et al. |
| D492,823 | S | 7/2004 | Hoshino et al. |
| D492,824 | S | 7/2004 | Tomasiak et al. |
| D505,760 | S | 5/2005 | Griffin |
| D506,042 | S | 6/2005 | Griffin et al. |
| D506,044 | S | 6/2005 | Griffin |
| D506,857 | S | 6/2005 | Griffin |
| D507,085 | S | 7/2005 | Griffin |
| D507,386 | S | 7/2005 | Griffin et al. |
| D507,388 | S | 7/2005 | Griffin |
| 6,912,757 | B2 | 7/2005 | Kaufman et al. |
| 6,938,299 | B2 | 9/2005 | Martinez et al. |
| 6,949,130 | B1 | 9/2005 | Grey et al. |
| D512,545 | S | 12/2005 | Griffin |
| D519,251 | S | 4/2006 | Hoshino et al. |
| D521,700 | S | 5/2006 | Griffin |
| D527,503 | S | 8/2006 | Griffin et al. |
| D527,504 | S | 8/2006 | Griffin et al. |
| D528,255 | S | 9/2006 | Griffin et al. |
| D528,256 | S | 9/2006 | Beth et al. |
| D528,718 | S | 9/2006 | Tomasiak et al. |
| 7,134,694 | B2 | 11/2006 | Young et al. |
| 7,159,272 | B2 | 1/2007 | Holsten et al. |
| 7,165,290 | B2 | 1/2007 | Martinez et al. |
| D537,578 | S | 2/2007 | Crevling, Jr. et al. |
| D537,992 | S | 3/2007 | Hoshino |
| 7,208,907 | B2 | 4/2007 | Norell et al. |
| RE39,595 | E | 5/2007 | Liu |
| D541,818 | S | 5/2007 | Rhea et al. |
| D549,903 | S | 8/2007 | Eccardt et al. |
| D551,681 | S | 9/2007 | Rhea et al. |
| 7,263,743 | B2 | 9/2007 | Holsten |
| 7,291,195 | B2 | 11/2007 | Gierer |
| 7,293,324 | B2 | 11/2007 | Chui et al. |
| D558,410 | S | 12/2007 | Hill et al. |
| 7,308,729 | B2 | 12/2007 | Seasholtz et al. |
| D560,865 | S | 1/2008 | Griffin et al. |
| D563,614 | S | 3/2008 | Crevling, Jr. et al. |
| D564,154 | S | 3/2008 | Hollis et al. |
| D564,158 | S | 3/2008 | Crevling, Jr. et al. |
| D565,266 | S | 3/2008 | Crevling, Jr. et al. |
| D565,269 | S | 3/2008 | Tomasiak et al. |
| 7,337,494 | B2 | 3/2008 | Baer et al. |
| 7,345,437 | B2 | 3/2008 | Baer et al. |
| D568,010 | S | 4/2008 | Crevling, Jr. et al. |
| D568,013 | S | 4/2008 | Crevling, Jr. et al. |
| D568,562 | S | 5/2008 | Griffin et al. |
| D568,564 | S | 5/2008 | Griffin et al. |

(56) References Cited

U.S. PATENT DOCUMENTS

D568,565 S 5/2008 Griffin et al.
D569,066 S 5/2008 Crevling, Jr. et al.
7,374,594 B2 5/2008 Gierer
7,374,595 B2 5/2008 Gierer
D571,513 S 6/2008 Griffin et al.
7,389,563 B2 6/2008 Martinez et al.
D573,319 S 7/2008 Crevling, Jr. et al.
D573,320 S 7/2008 Crevling, Jr. et al.
D577,164 S 9/2008 Williams et al.
7,443,123 B2 10/2008 Norell et al.
D580,115 S 11/2008 Theising et al.
D581,114 S 11/2008 Crevling, Jr. et al.
D587,414 S 2/2009 Griffin et al.
D588,316 S 3/2009 Griffin
D588,761 S 3/2009 Griffin
D590,554 S 4/2009 Griffin
D591,467 S 4/2009 Griffin et al.
7,513,464 B1 4/2009 Berfield
7,549,191 B2 6/2009 Seasholtz et al.
D595,910 S 7/2009 Holllis et al.
D596,359 S 7/2009 Hollis et al.
D596,362 S 7/2009 Crevling, Jr. et al.
7,555,809 B2 7/2009 Liu
D599,064 S 8/2009 Crevling, Jr. et al.
D599,968 S 9/2009 Crevling, Jr. et al.
D601,318 S 9/2009 Williams et al.
D601,319 S 9/2009 Williams et al.
D601,320 S 9/2009 Williams et al.
D602,661 S 10/2009 Griffin et al.
D606,716 S 12/2009 Crevling, Jr. et al.
7,654,480 B2 2/2010 Baer et al.
7,669,279 B2 3/2010 Crevling, Jr. et al.
D614,369 S 4/2010 Theising et al.
D615,259 S 5/2010 Theising et al.
D617,065 S 6/2010 Williams et al.
D617,514 S 6/2010 Hollis et al.
D618,870 S 6/2010 Williams et al.
D622,463 S 8/2010 Wolfe, Jr. et al.
D623,367 S 9/2010 Gottschall et al.
D623,812 S 9/2010 Seasholtz et al.
D623,813 S 9/2010 Seasholtz et al.
D624,258 S 9/2010 Crevling, Jr. et al.
7,789,952 B2 9/2010 Tomasiak
7,832,049 B2 11/2010 Hollis
7,859,224 B2 12/2010 Baer et al.
D631,216 S 1/2011 Crevling et al.
D631,627 S 1/2011 Crevling et al.
D632,444 S 2/2011 Griffin et al.
D634,084 S 3/2011 Griffin et al.
D634,494 S 3/2011 Theising et al.
D637,778 S 5/2011 Crevling et al.
D638,180 S 5/2011 Griffin et al.
D640,024 S 6/2011 Crevling et al.
D640,849 S 6/2011 Gottschall et al.
7,971,314 B2 7/2011 Hollis
D643,169 S 8/2011 Calvert
D644,800 S 9/2011 Seasholtz et al.
D644,801 S 9/2011 Crevling et al.
D646,033 S 9/2011 Crevling, Jr. et al.
8,015,661 B2 9/2011 Baer et al.
8,016,902 B2 9/2011 Makarov
D646,860 S 10/2011 Liu et al.
D647,260 S 10/2011 Hollis et al.
D647,261 S 10/2011 Schultz et al.
8,037,571 B2 10/2011 Butts et al.
8,074,321 B2 12/2011 Fry et al.
8,075,650 B2 12/2011 Hale
D657,101 S 4/2012 Williams et al.
D659,315 S 5/2012 Hollis et al.
D663,952 S 7/2012 Crevling, Jr. et al.
D664,354 S 7/2012 Crevling, Jr. et al.
D666,369 S 8/2012 Williams et al.
8,261,407 B2 9/2012 Bozzelli et al.
D669,646 S 10/2012 Theising et al.
D670,045 S 10/2012 Crevling, Jr. et al.
D670,046 S 10/2012 Theising et al.
D670,048 S 10/2012 Theising et al.
8,312,591 B1 11/2012 Wolfe, Jr. et al.
D672,929 S 12/2012 Gottschall et al.
D675,389 S 1/2013 Seasholtz et al.
8,341,803 B2 1/2013 Gardner et al.
D676,205 S 2/2013 Theising et al.
D676,207 S 2/2013 Gottschall et al.
8,402,599 B2 3/2013 Charlton et al.
D679,877 S 4/2013 Crevling, Jr. et al.
8,418,312 B2 4/2013 Rhea et al.
D683,090 S 5/2013 Griffen et al.
D683,091 S 5/2013 Griffen et al.
D683,507 S 5/2013 Liu et al.
8,439,375 B2 5/2013 Martinez
D688,842 S 8/2013 Liu et al.
8,533,902 B2 9/2013 Norell et al.
8,533,906 B2 9/2013 Liu
8,533,907 B2 9/2013 Eccardt et al.
D691,338 S 10/2013 Schultz et al.
D691,339 S 10/2013 Griffen et al.
8,590,103 B2 11/2013 Wolfe, Jr.
D697,679 S 1/2014 Wolfe, Jr. et al.
8,631,539 B2 1/2014 Williams et al.
8,689,396 B2 4/2014 Wolfe et al.
8,707,497 B2 4/2014 Liu
8,726,461 B2 5/2014 Makarov et al.
8,732,898 B2 5/2014 Fry et al.
8,739,358 B2 6/2014 Stephens et al.
8,752,235 B2 6/2014 Gordon
8,756,756 B2 6/2014 Theising et al.
D709,658 S 7/2014 Griffen et al.
8,806,702 B2 8/2014 Wolfe, Jr. et al.
D713,109 S 9/2014 Seasholtz et al.
D713,111 S 9/2014 Gottschall et al.
D714,504 S 9/2014 Gottschall et al.
D717,507 S 11/2014 Fry et al.
D719,911 S 12/2014 Lathrop et al.
D725,856 S 3/2015 Schultz et al.
8,973,196 B2 3/2015 Tomasiak
8,997,308 B2 4/2015 Ruiz et al.
9,003,599 B1 4/2015 Fry
9,003,600 B2 4/2015 Norell et al.
D728,875 S 5/2015 Fry et al.
9,038,236 B2 5/2015 Fry et al.
9,107,549 B2 8/2015 Crevling, Jr. et al.
D740,504 S 10/2015 Williams et al.
9,167,942 B1 10/2015 Seasholtz et al.
D743,655 S 11/2015 Holsten et al.
9,192,270 B2 11/2015 Westbrook et al.
9,198,552 B2 12/2015 Wolfe et al.
9,238,451 B2 1/2016 Norell et al.
9,282,861 B2 3/2016 Schultz et al.
9,305,727 B2 4/2016 Holsten
9,320,397 B2 4/2016 Gottschall et al.
9,345,372 B2 5/2016 Williams et al.
D758,683 S 6/2016 Seasholtz et al.
D762,335 S 7/2016 Fry et al.
9,402,516 B2 8/2016 Pilch
2002/0020036 A1 2/2002 Martin et al.
2002/0108204 A1 8/2002 Buss et al.
2004/0231096 A1* 11/2004 Battle ..... A47L 5/362 15/414
2005/0055794 A1* 3/2005 Marshall ..... A47L 5/225 15/353
2006/0087191 A1 4/2006 Norell et al.
2006/0260866 A1 11/2006 Tomasiak
2007/0251049 A1 11/2007 Wolfe, Jr.
2007/0256271 A1 11/2007 Rhea
2008/0010983 A1 1/2008 Morgan et al.
2008/0115312 A1* 5/2008 DiPasquale ..... A47L 5/365 15/327.2
2009/0123293 A1 5/2009 Gierer et al.
2010/0162515 A1* 7/2010 Stephens ..... A47L 5/362 15/323
2011/0107549 A1 5/2011 Crevling, Jr. et al.
2012/0246866 A1 10/2012 Holsten
2012/0311811 A1 12/2012 Hollis et al.
2013/0220426 A1 8/2013 Vinson

(56) References Cited

U.S. PATENT DOCUMENTS

| | | | |
|---|---|---|---|
| 2013/0228194 | A1 | 9/2013 | Holsten |
| 2014/0041142 | A1 | 2/2014 | Theising |
| 2014/0075711 | A1 | 3/2014 | Sang et al. |
| 2014/0130327 | A1 | 5/2014 | Theising |
| 2014/0182078 | A1 | 7/2014 | Gierer et al. |
| 2014/0201943 | A1 | 7/2014 | Williams |
| 2014/0208537 | A1 | 7/2014 | Williams et al. |
| 2014/0223871 | A1 | 8/2014 | Makarov |
| 2014/0299297 | A1 | 10/2014 | Williams |
| 2015/0013101 | A1 | 1/2015 | Wolfe, Jr. et al. |
| 2015/0289739 | A1 | 10/2015 | Westbrook et al. |
| 2015/0320281 | A1 | 11/2015 | Ritterling et al. |
| 2015/0342432 | A1 | 12/2015 | Blackwell, Jr. et al. |
| 2015/0342433 | A1 | 12/2015 | Blackwell, Jr. et al. |
| 2016/0037988 | A1 | 2/2016 | Schultz |
| 2016/0037989 | A1 | 2/2016 | Theising et al. |
| 2016/0066758 | A1 | 3/2016 | Holsten |
| 2016/0100731 | A1 | 4/2016 | Hollis |
| 2016/0102675 | A1 | 4/2016 | Holsten |
| 2016/0106281 | A1 | 4/2016 | Liu |
| 2016/0120383 | A1 | 5/2016 | Stanek et al. |
| 2016/0120384 | A1 | 5/2016 | Bian et al. |
| 2016/0195097 | A1 | 7/2016 | Patrick |

FOREIGN PATENT DOCUMENTS

| | | | |
|---|---|---|---|
| AU | 2016200049 | A1 | 7/2016 |
| CA | 32238 | S | 3/1970 |
| CA | 53418 | S | 10/1984 |
| CA | 54451 | S | 5/1985 |
| CA | 54491 | S | 5/1985 |
| CA | 57715 | S | 12/1986 |
| CA | 60474 | S | 3/1988 |
| CA | 60506 | S | 3/1988 |
| CA | 1263804 | | 12/1989 |
| CA | 1264212 | | 1/1990 |
| CA | 1266157 | | 2/1990 |
| CA | 71355 | S | 8/1992 |
| CA | 74506 | S | 7/1994 |
| CA | 75752 | S | 2/1995 |
| CA | 76560 | S | 6/1995 |
| CA | 76849 | S | 7/1995 |
| CA | 77264 | S | 9/1995 |
| CA | 82234 | S | 10/1997 |
| CA | 86193 | S | 3/1999 |
| CA | 87833 | S | 10/1999 |
| CA | 88311 | S | 12/1999 |
| CA | 88312 | S | 12/1999 |
| CA | 88313 | S | 12/1999 |
| CA | 88314 | S | 12/1999 |
| CA | 88315 | S | 12/1999 |
| CA | 88435 | S | 12/1999 |
| CA | 88590 | S | 1/2000 |
| CA | 89076 | S | 3/2000 |
| CA | 89077 | S | 3/2000 |
| CA | 89078 | S | 3/2000 |
| CA | 89522 | S | 5/2000 |
| CA | 89523 | S | 5/2000 |
| CA | 89996 | S | 7/2000 |
| CA | 89997 | S | 7/2000 |
| CA | 90731 | S | 10/2000 |
| CA | 92351 | S | 5/2001 |
| CA | 92352 | S | 5/2001 |
| CA | 92353 | S | 5/2001 |
| CA | 92354 | S | 5/2001 |
| CA | 92356 | S | 5/2001 |
| CA | 93446 | S | 9/2001 |
| CA | 97171 | S | 5/2002 |
| CA | 110763 | S | 1/2007 |
| CA | 110761 | S | 2/2007 |
| CA | 110762 | S | 2/2007 |
| CA | 113736 | S | 2/2007 |
| CA | 113800 | S | 2/2007 |
| CA | 114724 | S | 4/2007 |
| CA | 116746 | S | 7/2007 |
| CA | 116204 | S | 8/2007 |
| CA | 116155 | S | 9/2007 |
| CA | 117415 | S | 9/2007 |
| CA | 123173 | S | 7/2009 |
| CA | 130225 | S | 12/2009 |
| CA | 130228 | S | 12/2009 |
| CA | 130229 | S | 12/2009 |
| CA | 130302 | S | 12/2009 |
| CA | 131158 | S | 1/2010 |
| CA | 135008 | S | 12/2010 |
| CA | 137820 | S | 6/2011 |
| CA | 138004 | S | 6/2011 |
| CA | 138732 | S | 8/2011 |
| CA | 140470 | S | 12/2011 |
| CA | 140633 | S | 12/2011 |
| CA | 139030 | S | 3/2012 |
| CA | 140297 | S | 3/2012 |
| CA | 141500 | S | 5/2012 |
| CA | 142673 | S | 5/2012 |
| CA | 143048 | S | 5/2012 |
| CA | 143043 | S | 6/2012 |
| CA | 154942 | S | 2/2016 |
| CA | 158385 | S | 2/2016 |
| CN | 101695821 | | 4/2010 |
| CN | 203676996 | | 7/2014 |
| CN | 203898202 | | 10/2014 |
| DE | M94004690001 | | 6/1994 |
| EM | 000241419-0001 | S | 1/2005 |
| EM | 000283072-0003 | S | 3/2005 |
| EM | 000368105-0001 | S | 8/2005 |
| EM | 000461843-0003 | S | 2/2006 |
| EM | 000480801-0002 | S | 4/2006 |
| EM | 000485230-0002 | S | 4/2006 |
| EM | 000485081-0003 | S | 5/2006 |
| EM | 000574736-0001 | S | 10/2006 |
| EM | 000676838-0001 | S | 3/2007 |
| EM | 000676846-0001 | S | 3/2007 |
| EM | 000688478-0001 | S | 4/2007 |
| EM | 000690672-0001 | S | 4/2007 |
| EM | 000678776-0001 | S | 6/2007 |
| EM | 000819966-0001 | S | 11/2007 |
| EM | 000824123-0001 | S | 2/2008 |
| EM | 000823836-0006 | S | 4/2008 |
| EM | 000889407-0001 | S | 4/2008 |
| EM | 001046536-0001 | S | 1/2009 |
| EM | 001060552-0001 | S | 1/2009 |
| EM | 001171615-0002 | S | 10/2009 |
| EM | 001625658-0001 | S | 12/2009 |
| EM | 001669698-0001 | S | 3/2010 |
| EM | 001677022-0001 | S | 3/2010 |
| EM | 001677667-0001 | S | 3/2010 |
| EM | 001679408-0002 | S | 4/2010 |
| EM | 001699299-0001 | S | 5/2010 |
| EM | 001700816-0001 | S | 5/2010 |
| EM | 001701483-0003 | S | 5/2010 |
| EM | 001702002-0002 | S | 5/2010 |
| EM | 001704057-0001 | S | 5/2010 |
| EM | 001704586-0001 | S | 5/2010 |
| EM | 001705500-0001 | S | 5/2010 |
| EM | 001706862-0003 | S | 6/2010 |
| EM | 001707506-0001 | S | 6/2010 |
| EM | 001243943-0001 | S | 11/2010 |
| EM | 001806241-0001 | S | 3/2011 |
| EM | 001941220-0002 | S | 11/2011 |
| EM | 001971672-0002 | S | 2/2012 |
| EM | 001976077-0002 | S | 2/2012 |
| EM | 001990904-0002 | S | 2/2012 |
| EM | 002093666-0001 | S | 9/2012 |
| EM | 002100842-0002 | S | 10/2012 |
| EM | 002177121-0001 | S | 2/2013 |
| EM | 002180364-0001 | S | 3/2013 |
| EM | 002214460-0001 | S | 4/2013 |
| EM | 002301150-0001 | S | 10/2013 |
| EM | 002443382-0002 | S | 5/2014 |
| EM | 001419154-0001 | S | 9/2014 |
| EM | 002523415-0001 | S | 9/2014 |
| EM | 001395123-0003 | S | 1/2015 |
| EM | 002682690-0001 | S | 6/2015 |
| EM | 002650077-0001 | S | 7/2015 |

(56) References Cited

FOREIGN PATENT DOCUMENTS

| | | | |
|---|---|---|---|
| EM | 002316943-0001 | S | 8/2015 |
| EM | 002289520-0001 | S | 9/2015 |
| EM | 003101526-0001 | S | 5/2016 |
| EP | 0894467 | | 12/2003 |
| EP | 1600090 | | 6/2006 |
| EP | 1792558 | | 6/2007 |
| EP | 1466551 | | 3/2010 |
| EP | 2712298 | | 4/2014 |
| EP | 2375953 | | 6/2015 |
| EP | 2656895 | | 5/2016 |
| EP | 2498658 | | 6/2016 |
| EP | 3030125 | | 6/2016 |
| FR | 2442036 | | 6/1980 |
| GB | 2141523 | | 12/1984 |
| GB | 2083435 | S | 7/1999 |
| GB | 2488479 | | 8/2012 |
| GB | 2514088 | | 11/2014 |
| GB | 2528435 | | 1/2016 |
| GB | 2534303 | | 7/2016 |
| GB | 2534304 | | 7/2016 |
| GR | 871950 | | 4/1988 |
| IE | 791580 | | 2/1980 |
| IE | 892095 | | 1/1990 |
| IN | 211024 | | 12/2007 |
| IN | 5507DELNP2011 | A | 10/2012 |
| MX | 9702314 | A | 2/1998 |
| MX | PA00010735 | | 7/2002 |
| MX | 2011006147 | | 12/2011 |
| WO | WO 2006/057680 | | 6/2006 |
| WO | WO 2006/127244 | | 11/2006 |
| WO | WO 2007/025175 | | 3/2007 |
| WO | WO 2007/073415 | | 6/2007 |
| WO | WO 2012/150929 | | 11/2012 |
| WO | WO 2014/008754 | | 1/2014 |
| WO | WO 2014/154276 | | 10/2014 |
| WO | WO 2016/000558 | | 1/2016 |
| WO | WO 2016/005754 | | 1/2016 |

* cited by examiner

PORTABLE VACUUM AND RELATED ACCESSORIES

This U.S. Non-Provisional patent application claims the benefit of priority from U.S. Provisional Patent Application Ser. No. 62/423,661, filed Nov. 17, 2016, the entire disclosure of which is hereby incorporated by reference in its entirety.

FIELD

The present disclosure generally relates to vacuum devices. More specifically, the present disclosure relates to canister-style vacuum units and devices commonly referred to as wet-dry vacuums. Vacuum devices of the present disclosure include vacuums that do not commonly comprise a collection bag and are therefore operable to collect various solids and liquids. Devices of the present disclosure also relate to various vacuum accessories and improvements that are not limited to wet-dry style vacuum devices.

BACKGROUND

Conventional wet-dry vacuums generally comprise a canister or other receptacle with a vacuum unit including a motor positioned atop the canister. The vacuum motor creates a vacuum force that is operable to draw collected contents into an interior volume of the canister. The vacuum unit typically comprises an exhaust vent. The lack of a vacuum bag provides for a relatively simple device that is operable to collect various different solids and fluids within the canister. Such devices, including those that are commercially available from Shop-Vac™ are therefore generally referred to as wet-dry vacuums. These devices also typically comprise caster wheels extending from the canister to render the device portable.

U.S. Pat. No. 6,237,187 to Hult et al., which is hereby incorporated by reference in its entirety, discloses a dolly device that is operable to connect to conventional wet-dry vacuums. U.S. Pat. No. 6,237,187 to Hult et al., however, fails to disclose various novel features and devices of the present disclosure.

U.S. Pat. No. 8,997,308 to Ruiz et al., which is hereby incorporated by reference in its entirety, discloses a wet-dry vacuum with a lid. Ruiz et al. fails to disclose various features and devices of the present disclosure, including but not limited to various ergonomic features as shown and described herein.

U.S. Pat. No. 6,347,429 to Hult et al., which is hereby incorporated by reference in its entirety, discloses a drain system for a wet-dry vacuum. This reference, however, fails to disclosure various novel features of the present disclosure as shown and described herein.

U.S. Pat. No. 6,938,299 to Martinez et al., which is hereby incorporated by reference in its entirety, discloses a tool caddie for use with a conventional wet-dry vacuum. Martinez et al., however, fail to disclose various features of the present disclosure.

U.S. Pat. No. 9,003,599 to Fry, which is hereby incorporated by reference in its entirety, discloses a canister or tank-type vacuum device with hose-receiving storage features. Fry, however, fails to disclose various features of the present disclosure, including hose-receiving and ergonomic features as shown and described herein.

SUMMARY

In one embodiment, a vacuum cleaner device is provided, the device comprising a main body portion and a vacuum element having a vacuum motor and a vacuum hose for conveying debris into a receptacle provided within the main body portion. An upwardly extending sidewall is provided on the main body portion and defines an upwardly open space between the sidewall and the vacuum motor within which the vacuum hose can be at least partially wound for storage.

In various embodiments, vacuum devices are provided with various features for enhancing the ergonomics and user-friendliness of a canister or wet-dry vacuum. Such features are shown and described herein in various different embodiments. It will be expressly recognized that certain devices and features shown and described herein are not limited to the embodiment or embodiments with which they are described or shown in combination with. Various combinations of features shown herein are contemplated, even if such combinations are not shown in the drawings or specifically described in the Specification. One of skill in the art will recognize that various features of the present disclosure may be combined. Furthermore, one of ordinary skill in the art would understand how such combinations could be achieved. For example, it is contemplated that a vacuum device of the present disclosure may comprise a combination of an upwardly open sidewall, a handle for grasping and emptying the device, and a viewport or spyglass provided in a sidewall of a canister of the device, even if such a combination is not specifically shown in the Figures. It will therefore be recognized that the various features and improvements shown herein are not mutually exclusive features.

International Patent Application PCT/EP2013/056662 to Venturini et al., which is hereby incorporated by reference in its entirety, discloses a vacuum or suction device with a filter device and filter holder. The filter device and holder are removable such that the they may be cleaned or replaced. In certain embodiments of the present disclosure, a vacuum device is provided with a filter that is separately removable from the device and is accessible from an outside of the device with minimal device deconstruction or rearrangement being required. Devices and features disclosed in PCT/EP2013/056662 to Venturini et al. and related to this concept are specifically contemplated for use with embodiments of the present disclosure.

In certain embodiments of the present disclosure, a vacuum device is provided with a removable waste container drawer. Preferably, the removable waste container is completely removable from a remainder of the device, as opposed to drawer or slide-out devices that are not completely detachable. In such embodiments, a user is provided with the ability to remove and empty the waste container without lifting and tilting the entire machine. The user also does not need to remove the motor/filter assembly to empty device contents. The user may focus on manipulating only the receptacle or part that requires emptying, thereby providing a cleaner and more efficient system and device.

In various embodiments, a variable-length cleaning wand or handle is provided. As shown and described herein, cleaning wands of the present disclosure are contemplated as comprising at least one telescoping member that is adjustable in length. In certain embodiments, the handle comprises a plurality of pre-set length positions and a lock and release member to allow a user to selectively unlock, adjust, and lock a length of the device.

In certain embodiments, a vacuum device is provided with a filter-cleaning element. Filter-cleaning elements of the present disclosure are contemplated as comprising a comb-like structure that scours, knocks, or cleans accumulated dirt from a filter element (e.g. a paper filter) and allows the dirt to drop or accumulate into the waste collection area of the device when the filter element is removed from the device. Preferably, the comb-like cleaning element is only provided in a position of use when the bucket or collection area is in place and the filter is removed. In certain embodiments, a filter cleaner is provided that is mounted on a surface that retracts and extends or rotates between a neutral position of non-use and a working position corresponding to the waste bucket being inserted or in a position to collect debris. The filter cleaner is thus only engaged and operable to remove dirt from a filter when the waste bucket is in place.

In some embodiments, a vacuum device is provided that comprises a cord storage feature. The cord storage feature comprises a receptacle in which a coiled or retractable power cord is provided. A retractable power cord (for example) comprises a coiled cord with an elasticity provided by at least one of the coiled nature of the cord and an elastic coating provided on the cord (e.g. an elastic material, a wrapped coil spring, etc.). In alternative embodiments, a cord is provided on a spring-loaded reel to selectively extend and retract the cord. Cords of the present disclosure are extendable between a coiled or stored length of less than approximately 1.0 feet and an extended length of at least approximately 10 feet.

In various embodiments of the present disclosure, a vacuum device is provided that comprises a hose and the hose comprises an extendable hose. Vacuum hoses of the present disclosure preferably comprise an accordion-style stretch hose that is capable of retracting when not in use, thereby increasing a storage ability of the hose and the device generally.

In various embodiments of the present disclosure, vacuum devices comprise at least one kick-back pedal. A combination of a handle and a kick-back pedal provides a user with the ability to quickly and easily tip or rotate the device such that the device is easily transported on two wheels (for example).

In various embodiments of the present disclosure, a vacuum device comprises an upper portion including a vacuum unit that is removable from a main body portion of the device. Deconstruction of the device allows for access to and emptying of an interior volume of the device. An upper portion of the vacuum may be connected to a lower portion of the vacuum including a collection container by clips and/or various other securing and locking means.

In certain embodiments, it is contemplated that a bottom portion of a vacuum device is weighted to shift a center of gravity of the device toward the base. Conventional canister vacuum devices generally comprise a plastic chamber or canister with a vacuum unit disposed on a top of the chamber. The weight distribution of such devices provides a relatively high center of gravity and renders the devices prone to tipping, particularly when pulled or conveyed by a vacuum hose. Embodiments of the present disclosure contemplate providing a metal base and/or ballast provided in the base to shift the center of mass of the device toward the bottom portion. In certain embodiments, a plate or similar ballast member is provided that comprises a mass that is approximately equal to a vacuum element that is provided in opposing relationship to the ballast, at least with respect to the ballast. In such embodiments, a center of mass of the device is generally disposed in a geometric center of the device.

Various embodiments and features are disclosed herein. It is contemplated that various features and devices shown and/or described with respect to one embodiment may be combined with or substituted for features or devices of other embodiments regardless of whether or not such a combination or substitution is specifically shown or described herein.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
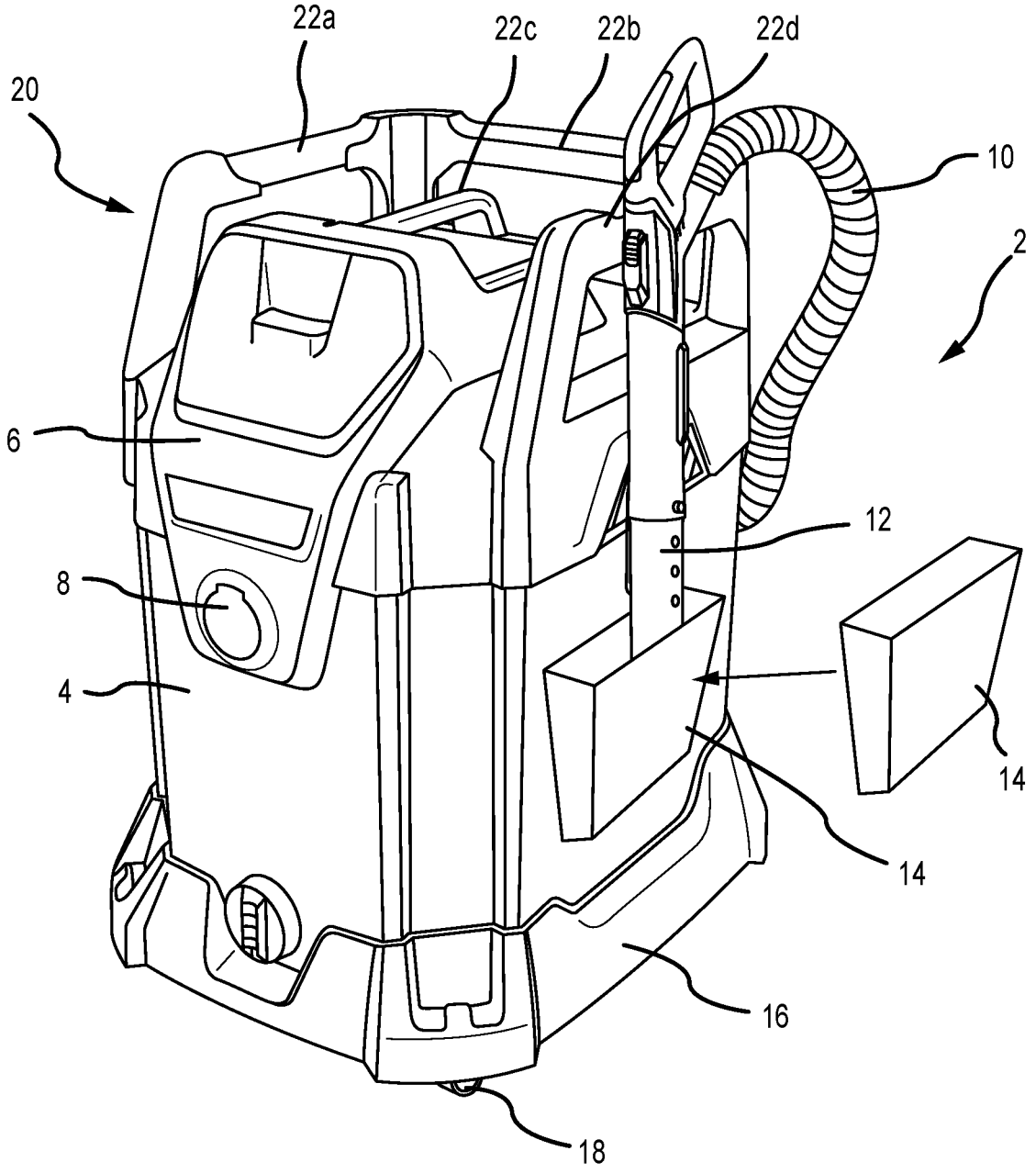
FIG. 1 is a front perspective view of a vacuum cleaner according to one embodiment of the present disclosure.

FIG. 1 is a perspective view of a vacuum device according to one embodiment of the present disclosure. As shown, the device 2 comprises certain common features of a wet-dry vacuum. It will be recognized, however, that features of FIG. 1 and other features shown and described herein may be provided on various devices. It will be expressly recognized that various features and improvements shown and described herein may be provided on various different types of vacuums and other devices.

As shown in FIG. 1, the vacuum device 2 comprises a main body portion 4 with a longitudinal axis that extends substantially vertically when the wheels 18 of the device are provided on a substantially flat horizontal ground surface. The vacuum device 2 comprises at least one port 8. The port 8 is operable to serve as an airflow port for the intake of air, fluid and debris by way of a hose 10. It is also contemplated, however, that the port 8 is operable as an exhaust port (for example, the vacuum pump is reversed from a normal flow state). The vacuum device 2 comprises a plurality of wheels 18, such as caster wheels, provided on a lower portion 16 of the device to enable and facilitate transportation of the device 2. An upper portion 20 of the device 2 comprises an upwardly open area with a plurality of handles or raised features 22*a*, 22*b*, 22*d* that form an upstanding portion. The upstanding portion, at least as shown in FIG. 1 provides for various user-interface features whereby the device may be grasped by a user. Additionally, the upstanding portion comprises an at least partially open area that is operable to and arranged to receive a vacuum hose 10 in a position of storage. A stowage area is generally provided between the raised features 22*a*, 22*b*, 22*d* and the vacuum motor 6. A central handle 22*c* is provided that extends from the vacuum motor 6. In some embodiments, the raised features 22*a*, 22*b*, 22*d* are operable to move the device 2 and/or remove an upper portion 20 of the device from a main body portion 4, such as may be desirable for emptying, cleaning or servicing the device.

As further shown in FIG. 1, a selectively removable storage compartment 14 is provided. The storage compartment 14 is shown as a compartment comprising an opening and an internal storage volume that is operable to receive various features and accessories. As shown in FIG. 1, the compartment 14 is operable to receive and house a vacuum wand 12. However, the compartment 14 is not limited to housing any particular item and it is contemplated that the compartment may receive and store various articles including, but not limited to, cleaning tools, solutions, articles, debris, etc. In various embodiments, the selectively removable compartment 14 is selectively securable to the main body portion 4 of the device 2. In some embodiments, the compartment 14 is magnetically connected to the main body portion. In other embodiments, the compartment 14 comprise hooks or clips that are connected to the main body portion (e.g. holes or recesses in the main body portion).

Figure 2:
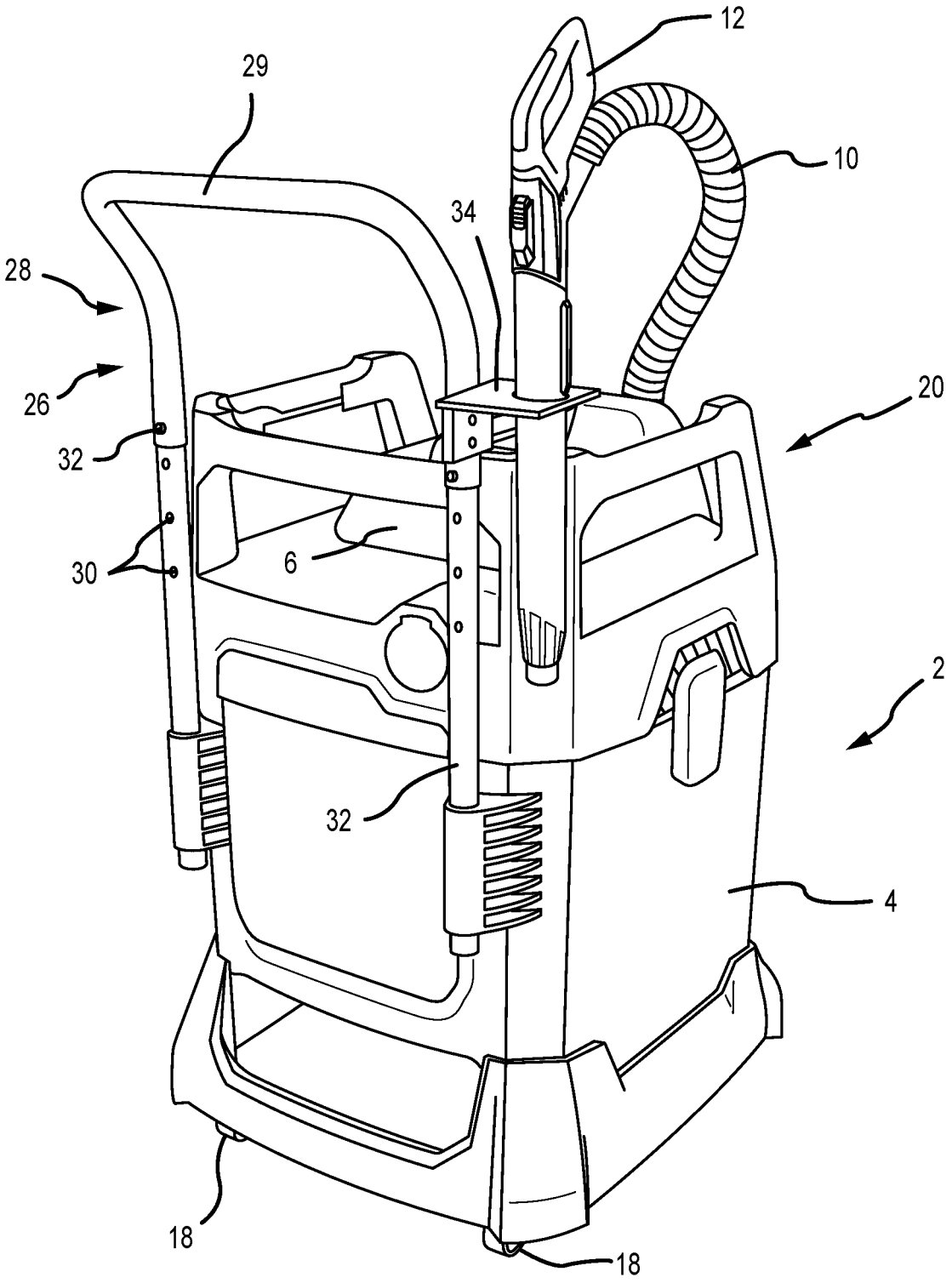
FIG. 2 is a rear perceptive view of the vacuum cleaner according to the embodiment of FIG. 1.

FIG. 2 is a rear perspective view of a vacuum device 2 according to another embodiment of the present disclosure. The device 2 of FIG. 2 comprises features shown and described with respect to FIG. 1 and further comprises a user-interface member in the form of a handle 26. The handle 26 comprises a substantially horizontal member 29 that is operable to be grasped by a user and is further operable to convey a force to the device 2. The handle 26 further comprises vertical supports 28. The vertical supports 28 comprise telescoping and/or translatable members 32, 28 such that an overall height of the handle is adjustable. In the depicted embodiment, a handle height is adjustable and selected by a spring biased pin 32 that is operable to communicate with a plurality of apertures 30 provided in the vertical members 32 of the handle. As further shown in FIG. 2, the handle 26 comprises a holster or receiving member 34 for selectively receiving a vacuum wand 12 when the vacuum wand 12 is not in use. The holster 34 is secured to and moveable with at least a portion of the handle 26. The holster 34 is shown as comprising a plate with an aperture for receiving an elongate vacuum wand in FIG. 2. In alternative embodiments, however, it is contemplated that the holster comprises various different shapes. For example, it is contemplated that holsters may be provided that comprise clamps or clips that are partially open to receive a vacuum wand. In further embodiments, it is contemplated that the holster comprises a magnetic plate that is operable to receive and connect to a magnetic portion of the vacuum wand. In yet further embodiments, it is contemplated that the holster comprises a slot within which a protrusion of the vacuum wand 12 may be received. Accordingly, it should be recognized that holsters of the present disclosure are contemplated as comprising various structures that are suitable to receive and retain a vacuum wand 12 and no limitation with respect to the structure of the holster is provided herewith.

Figure 3:
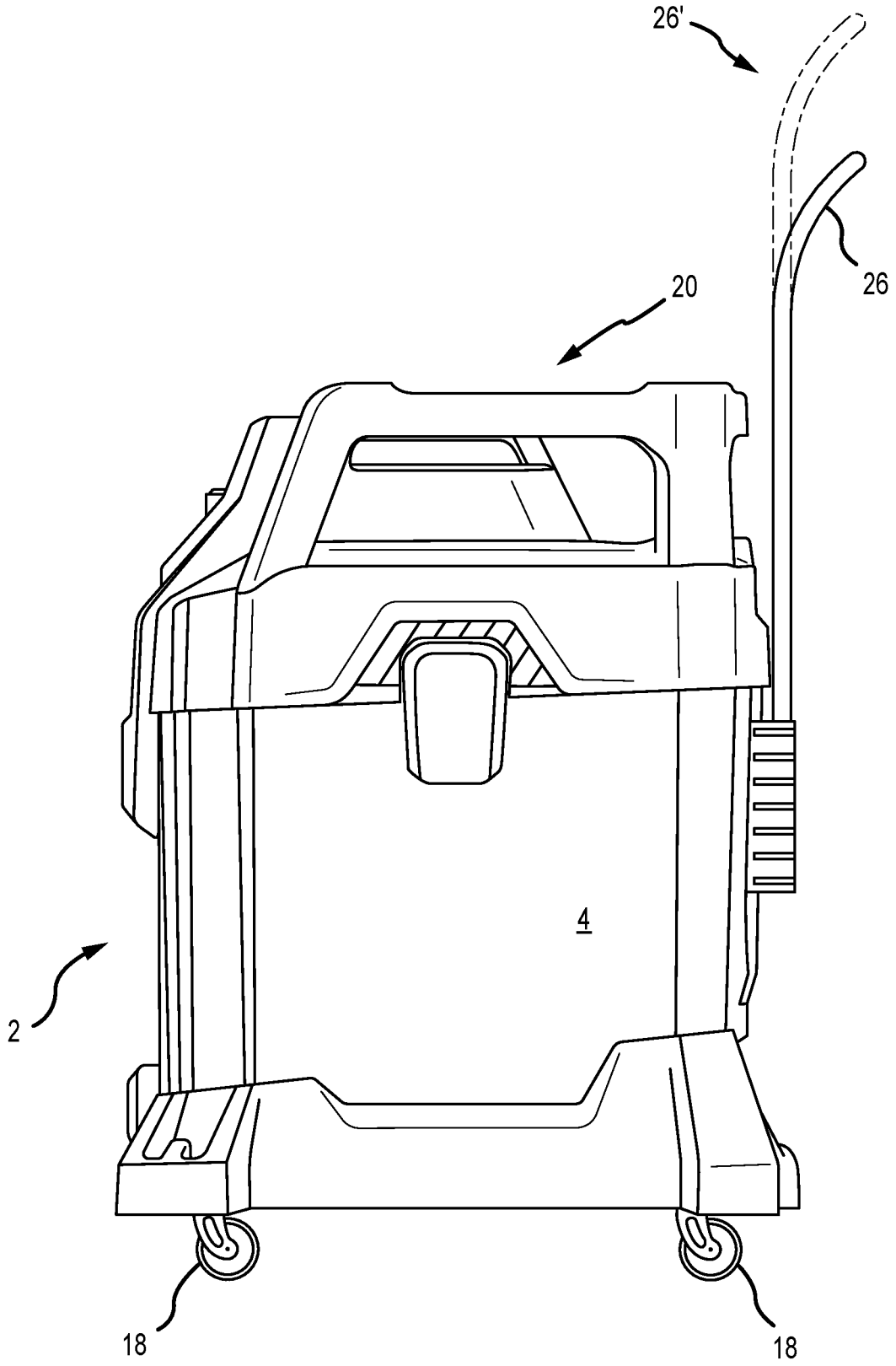
FIG. 3 is a side elevation view of the vacuum cleaner according to the embodiment of FIG. 1.

FIG. 3 is a side elevation view of a vacuum device 2 according to another embodiment of the present disclosure. As shown in FIG. 3, a vacuum device 2 is provided with a telescoping handle 26. The handle 26 comprises features and structure as shown in FIG. 2. The handle 26 is selectively extended by releasing locking means, which are contemplated as comprising spring-loaded balls or pins in at least some embodiments. The handle 26 may be selectively positioned in at least one storage position (i.e. with the handle compressed or retracted) and at least one position of use 26' (i.e. with the handle extended).

Figure 4:
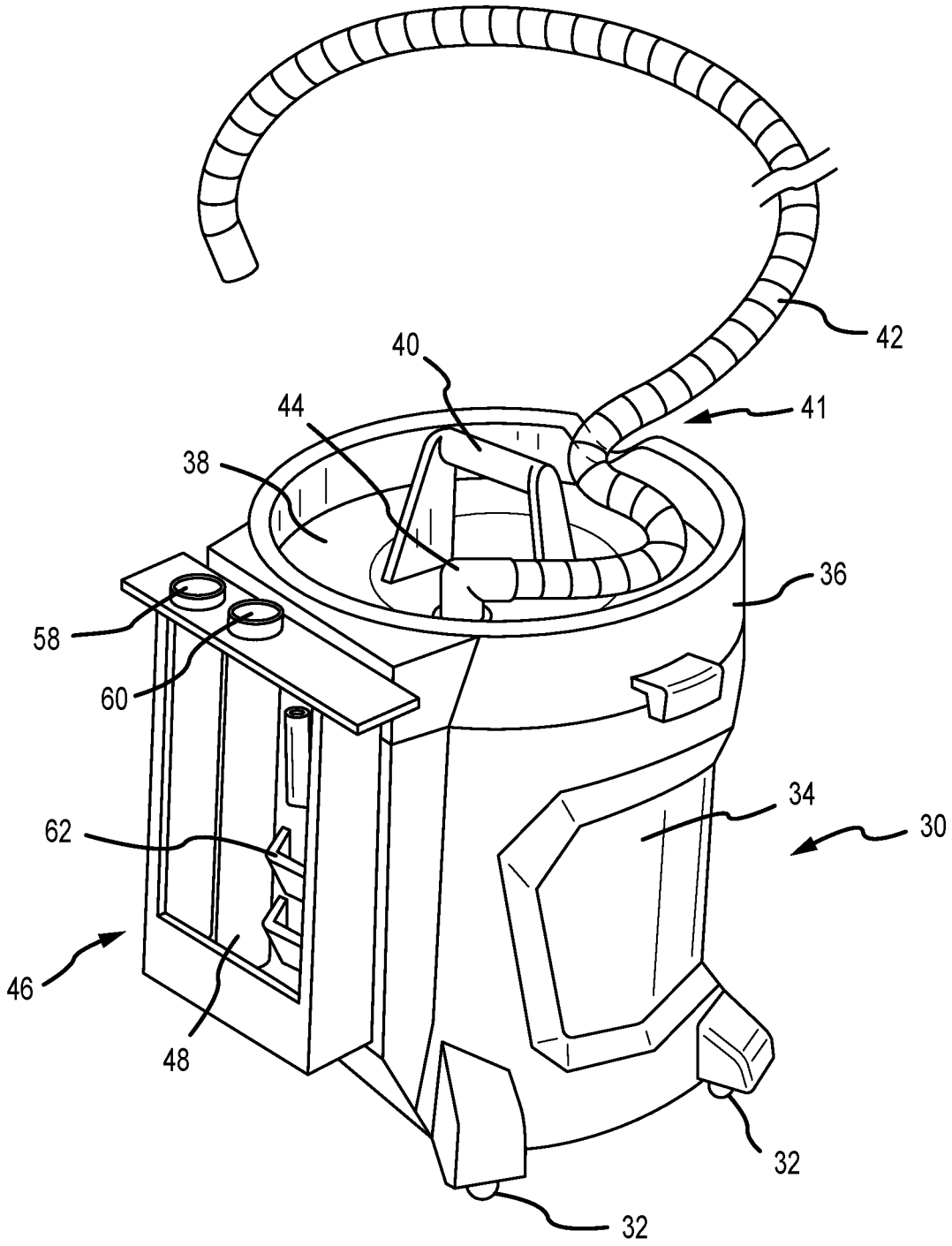
FIG. 4 is a front perspective view of a vacuum cleaner according to one embodiment of the present disclosure.

FIG. 4 depicts a vacuum device 30 according to one embodiment of the present disclosure. The vacuum device 30 comprises at least one intake 44 with a vacuum hose 42 extending therefrom. The intake 44 and associated hose 42 are preferably oriented to facilitate the wrapping of the hose 42 around a portion of the vacuum device 30 and to direct the hose 42 through a notch or recess 41 provided in an upwardly extending portion 36 of the device at least when the hose is unwound or provided in a position of use. In the embodiment of FIG. 1, the upwardly extending portion comprises a plurality of handles or raised features 22*a*, 22*b*, 22*d*. Accordingly, and "upwardly extending portion" as used herein is not limited to the sidewall or lip shown in FIG. 4.

As shown in FIG. 4, the vacuum device 30 further comprises an upstanding portion in the form of a vertically extending lip or sidewall 36 that extends around at least a portion of a circumference or perimeter of the device 30. The sidewall 36 is provided to create an at least partially enclosed volume 38 wherein the hose 42 may be stowed when not in use. The sidewall 36 comprises a gap 41 or passage to allow the hose 42 to extend from the sidewall, particularly when the hose 42 is in use. The height of the sidewall 36 may vary, based on a length and a diameter of a corresponding hose 42, for example. However, in various embodiments of the present disclosure, a sidewall 12 is provided comprising a height of between approximately six inches and approximately twenty-four inches. The sidewall 36 generally comprises a nest or storage volume for the hose 42 when the hose 42 is not in use. Accordingly, the thickness of the sidewall may vary and the present disclosure is not limited to a particular thickness of the sidewall. In various embodiments, it is contemplated that the sidewall comprises a thickness of less than approximately 2 inches.

The sidewall 36 of the embodiment provided in FIG. 4 creates an internal volume 38. A handle 40 is provided around which the hose (or other cords, for example) may be wrapped. In some embodiments, an upwardly extending portion of a vacuum motor is provided in a central area of the internal volume 38. The internal volume 38 comprises a space that accommodates and receives the hose 42 in a wrapped or stored manner. Although not shown in FIG. 4, the device 30 may further comprise various additional features for storing and stowing the hose 42. For example, clips may be provided on an interior portion of the sidewall 36. In certain embodiments, a lid, cap, or net is provided to cover an upper portion of the sidewall 36 and associated internal volume 38 to secure a hose 42. In certain embodiments, an upper portion of the device 30 is rotatable such that a coiled hose 42 provided within the internal volume 38 may be spun or spooled out of the internal volume.

In various embodiments, including but not limited to the embodiment shown in FIG. 4, an inlet port 44 comprises an elbow. As shown, the elbow comprises a ninety-degree bend such that at least a portion of a hose 42 connected to the vacuum 30 extends substantially perpendicularly to a longitudinal axis of the vacuum 30 as shown in FIG. 4. The port arrangement 44 including the elbow enables the hose 42 to extend in a manner that facilitates wrapping or coiling the hose 42 within the internal storage volume 38 and/or allows the hose to extend through the slot 41 during use. In various embodiments, different bends are provided in communication with the port 44. The elbow is contemplated as comprising a ninety-degree bend in some embodiments but the present disclosure is not limited to such embodiments. For example, where loss of pressure head known as "bend loss" is a concern, the elbow may comprise various different structure including, for example, rounded elbows and elbows with bends of less than ninety degrees. As is also shown in FIG. 4, the elbow is provided such that the hose 42 extends at least initially (i.e. at a point of connection to the elbow) substantially tangential to a circle formed by the internal volume 38 to further facilitate wrapping of the hose 42.

As is further shown in FIG. 4, the vacuum device 30 comprises a selectively removable storage compartment 46. The storage compartment 46 comprises various features for storing articles including, for example, pockets 62, one or more tubular holsters 58, 60 for housing a vacuum wand, for example, and an internal storage volume 48 within which various cleaning devices, articles, accessories, etc. may be stored. The storage member or compartment 46 is selectively removable and attachable to the main body portion 34 of the vacuum device 30. The storage member 46 is selectively securable to the main body portion 34 of the vacuum device 30 by various means and devices including, for example, magnetic attachments, hooks, resilient plastic clips, fasteners (screws, bolts, etc.) and various similar features that will be recognized by one of ordinary skill in the art as being useful for securing the storage member 46 to the vacuum 30.

Figure 5:
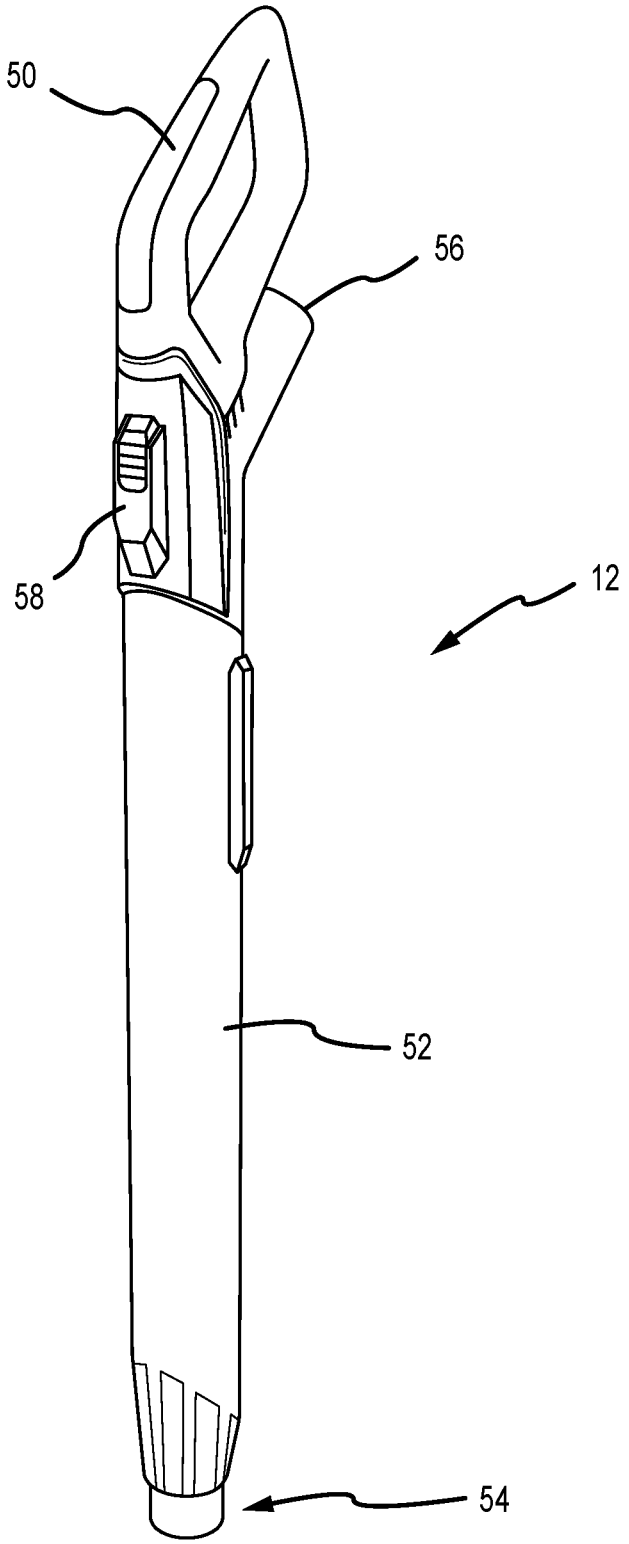
FIG. 5 is a front perspective view of a vacuum wand according to one embodiment of the present disclosure.

FIG. 5 is a perspective view of a vacuum wand 12 according to one embodiment of the present disclosure. Although various vacuum wands and similar devices are contemplated for use with vacuum devices shown and described herein, FIG. 5 illustrates a vacuum wand 12 according to one particular embodiment. As shown, the vacuum wand 12 comprises an elongate body portion 52 with a handle 50 provided on a proximal end and an intake 54 provided on a distal end. A vacuum port 56 is provided that is operable to receive and connect to a vacuum hose. A release 58 is provided that enables selective extension and retraction of certain features of the wand 12 as shown and described herein.

Figure 6:
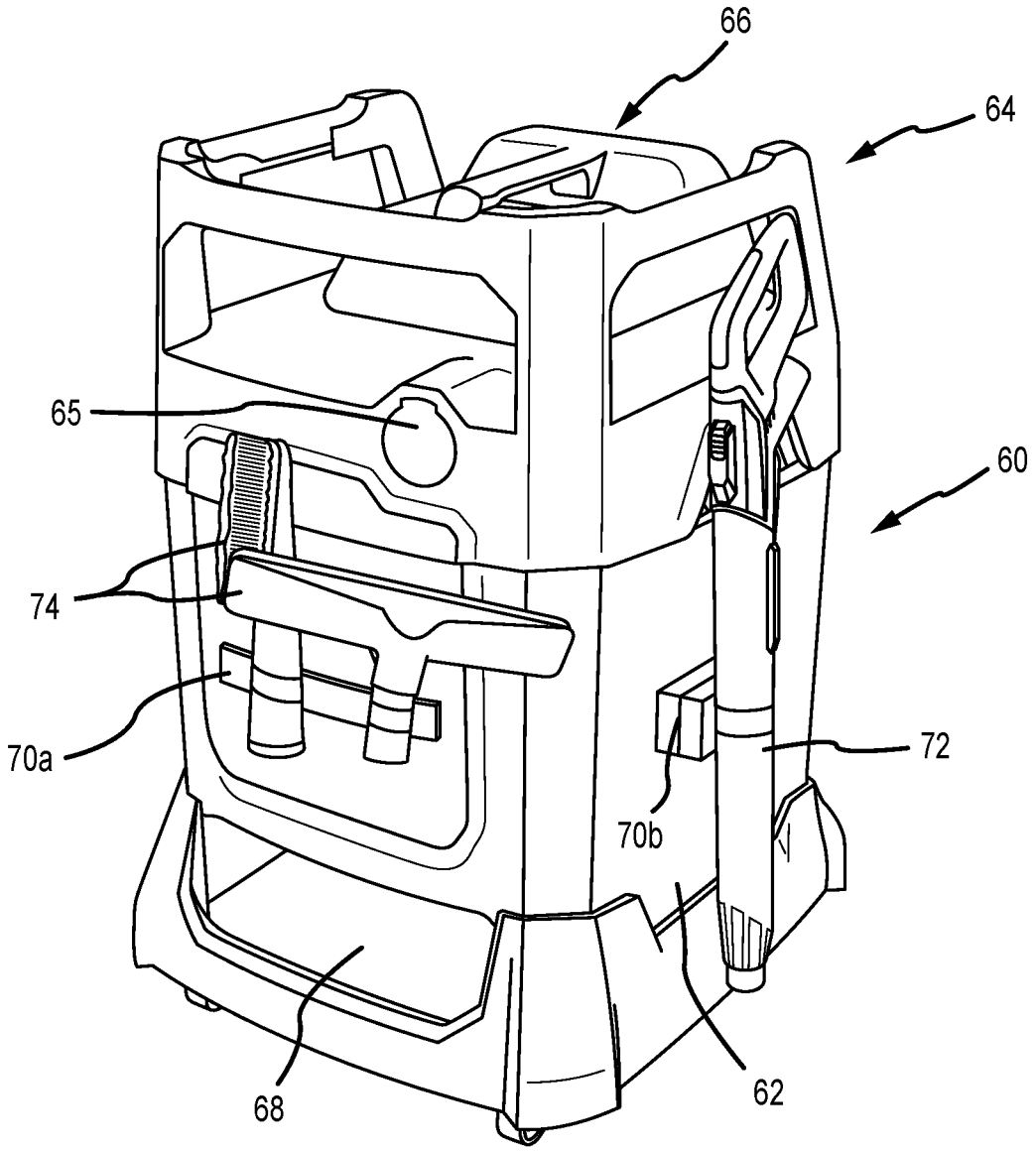
FIG. 6 is a perspective view of a vacuum cleaner according to one embodiment of the present disclosure.

FIG. 6 is a rear perspective view of a vacuum device 60 according to another embodiment of the present disclosure. The vacuum device 60 comprises a main body portion comprising an upper portion 64 and a lower portion 62 and a vacuum unit 66. As shown in FIG. 6, the vacuum device 60 further comprises a storage area 68 provided as a generic storage area that is separate from a debris collection area of the device. The storage area 68 is operable to receive various items and accessories. The embodiment of FIG. 6 further comprises magnetic storage features. As shown, first and second magnetic receiving members 70*a*, 70*b* are provided on the body of the vacuum device 60. The first magnetic receiving portion is operable to receive and hold various features and accessories including, but not limited to, vacuum cleaning accessories 74. A second magnetic receiving member 70*b* is provided that is also operable to receive and hold items. In the depicted embodiment, the second magnetic receiving member 70*b* is operable to selectively hold and retain a vacuum wand 72. It is contemplated that vacuum wands of the present disclosure comprise at least a portion that is ferrous or magnetically attracted to the magnetic storage feature(s). Although the magnetic storage features 70*a*, 70*b* are generally shown as strips provided on an exterior of the body of the vacuum 60, magnetic storage features are not limited to any particular shape or placement relative to the vacuum device. In some embodiments, it is contemplated that one or more panels or sides of the main body portion of the vacuum 60 are magnetic, and that the magnetic material or element is provided interior to a façade (e.g. plastic exterior) such that the magnetic element is generally not visible to a user. The embodiment of FIG. 6 comprises at least one port 65 for intake of fluid and debris and/or exhaust of contents.

Figure 7:
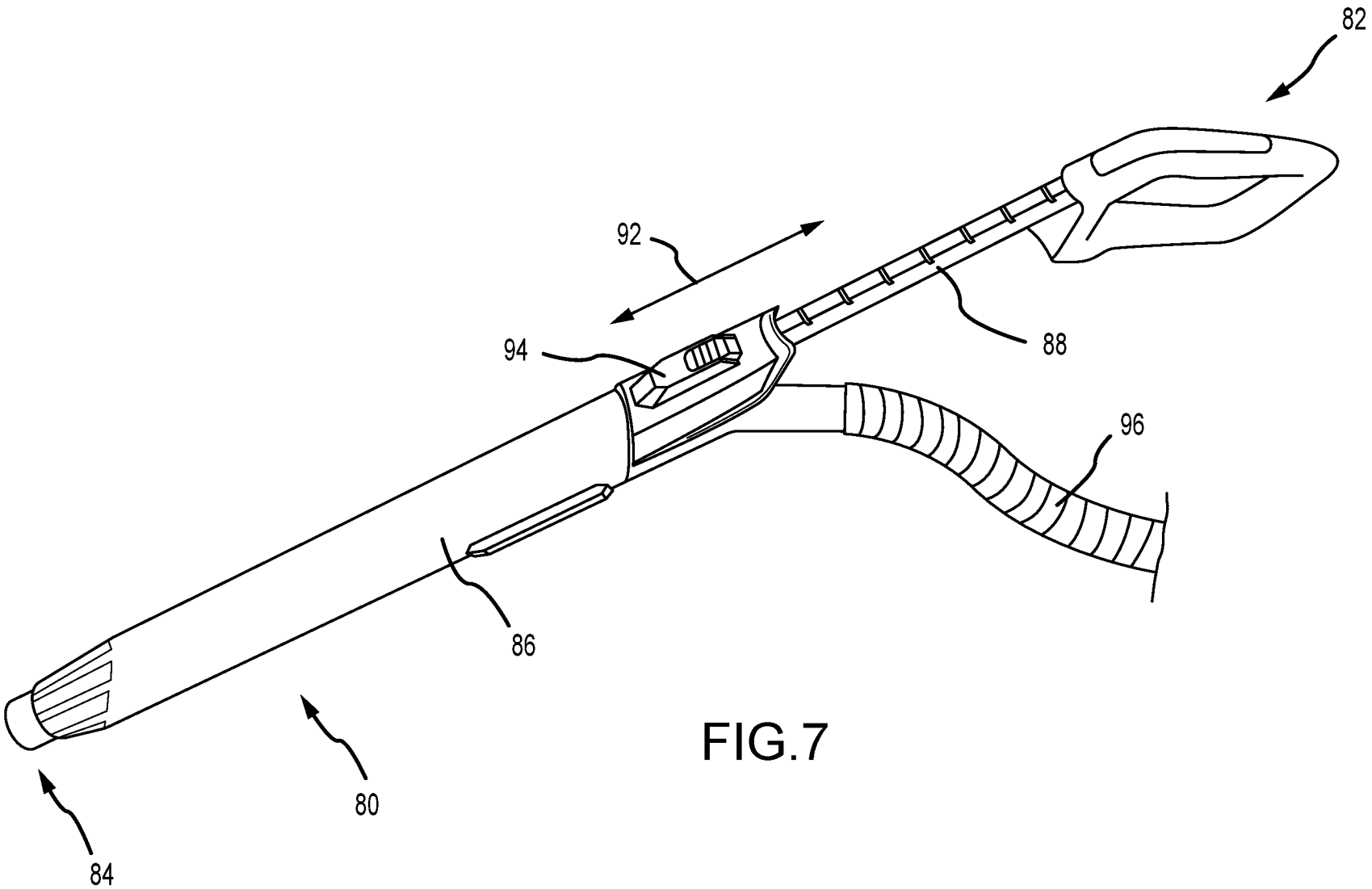
FIG. 7 is a front perspective view of a vacuum wand according to one embodiment of the present disclosure.

FIG. 7 is a perspective view of a vacuum wand 80 according to one embodiment of the present disclosure. As shown, the vacuum wand 80 comprises an elongate body portion 86 with a handle 82 on a proximal end and an intake port 84 on a distal end. A vacuum hose 96 is provided in fluid communication with the elongate body portion 86. The handle 82 comprises an extendable handle such that a total length of the vacuum wand 80 is adjustable. A release and/or latch 94 is provided and an elongate member 88 is provided with a plurality of slots or recesses to selectively secure a position of the handle 82 relative to the elongate body portion 86. The handle 82 is thus moveable in direction 92 indicated in FIG. 7.

Figure 8:
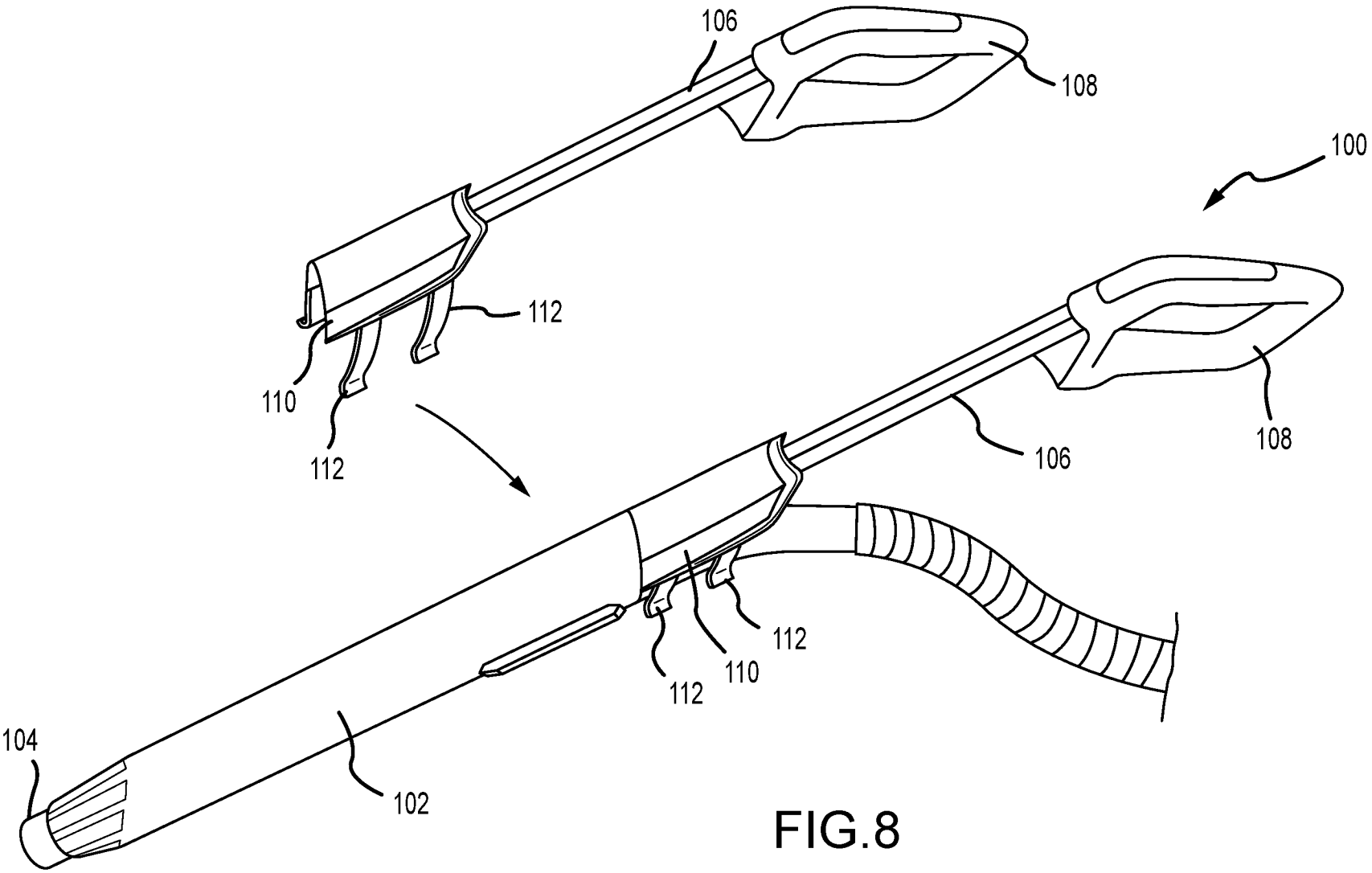
FIG. 8 is a front perspective view of a vacuum wand according to one embodiment of the present disclosure.

FIG. 8 is a perspective view of a vacuum wand 100 according to one embodiment of the present disclosure. The vacuum wand or cleaning accessory 100 comprises an attachment member 106. The attachment member 106 comprises a clip-on attachment having a grip 108, an elongate extension, and a distal end 110. The distal end 110 comprises grips 112 that are sized to clip on to or attach to a vacuum wand 100. The grips 112 preferably comprise members with at least some elasticity (e.g. spring steel, flexible plastic, etc.) that can be repeatedly applied to and removed from a vacuum wand 100.

While various embodiments of the system have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. A vacuum cleaner device comprising:

a vacuum motor and a vacuum hose;

a main body portion comprising an internal volume operable to house collected debris;

the main body portion comprising a lower portion having a plurality of wheels and an upper portion;

a handle in communication with the main body portion, the handle comprising a user-interface and being operable to convey the main body portion;

wherein the handle comprises an extendable portion that is convertible between at least a first position and a second position;

a storage compartment associated with the main body portion, the storage compartment being operable to receive and store articles and accessories; and an upwardly extending sidewall provided on the main body portion and defining an upwardly open space between the sidewall and the vacuum motor that is operable to receive the vacuum hose;

wherein the main body portion comprises a longitudinal axis, and the vacuum hose connects to a port on the upper portion and the vacuum hose extends substantially perpendicular to the longitudinal axis of the main body portion; and wherein the port is operable to receive fluids and solids and comprises an elbow operable to receive a vacuum hose.

2. The vacuum cleaner device of claim 1, wherein the storage compartment is associated with the main body portion and is selectively removable from the main body portion.

3. The vacuum cleaner device of claim 1, wherein a first portion of the elbow extends substantially parallel to a longitudinal axis of the main body portion and a second portion of the elbow extends substantially perpendicular to the longitudinal axis of the main body portion.

4. The vacuum cleaner device of claim 1, wherein the upwardly extending sidewall comprises at least one of a recess, a notch, a void and a gap to allow the vacuum hose to extend.

5. The vacuum cleaner device of claim 1, further comprising a magnetic element for selectively receiving and storing an accessory.

6. The vacuum cleaner device of claim 5, further comprising at least one of a vacuum head, a brush, and a tool comprising a magnetic element that is attracted to the magnetic element provided on the vacuum cleaner device.

7. A vacuum cleaner device comprising:

a vacuum motor and a vacuum hose;

a main body portion comprising an internal volume operable to house collected debris;

the main body portion comprising a lower portion and an upper portion;

a handle in communication with the main body portion, the handle comprising a user-interface and being operable to convey the main body portion;

a storage compartment associated with the main body portion, the storage compartment being operable to receive and store articles and accessories; and an upwardly extending portion provided on the main body portion and defining an upwardly open space between the upwardly extending portion and the vacuum motor that is operable to receive the vacuum hose, wherein the upwardly extending portion comprises at least one of a recess, a notch, a void and a gap to allow the vacuum hose to extend therethrough;

wherein the main body portion comprises a longitudinal axis, and the vacuum hose connects to the main body portion and extends substantially perpendicular to the longitudinal axis of the main body portion at a port operable to receive fluids and solids, and wherein the port comprises an elbow operable to receive a vacuum hose.

8. The vacuum cleaner device of claim 7, wherein the storage compartment is associated with the main body portion and is selectively removable from the main body portion.

9. The vacuum cleaner device of claim 7, wherein a first portion of the elbow extends substantially parallel to a longitudinal axis of the main body portion and a second portion of the elbow extends substantially perpendicular to the longitudinal axis of the main body portion.

10. The vacuum cleaner device of claim 7, further comprising a magnetic element for selectively receiving and storing an accessory.

11. The vacuum cleaner device of claim 10, further comprising at least one of a vacuum head, a brush, and a tool comprising a magnetic element that is attracted to the magnetic element provided on the vacuum cleaner device.

12. A vacuum cleaner device comprising:

a vacuum motor and a vacuum hose;

a main body portion comprising an internal volume operable to house collected debris;

the main body portion comprising a lower portion and an upper portion;

a handle in communication with the main body portion, the handle comprising a user-interface, an extendible portion and being operable to convey the main body portion and wherein the extendable portion is convertible between at least a first position and a second position;

a storage compartment associated with the main body portion, the storage compartment being operable to receive and store articles and accessories; and an upwardly extending portion provided on the main body portion and defining an upwardly open space between the upwardly extending portion and the vacuum motor that is operable to receive the vacuum hose, wherein the upwardly extending portion comprises at least one of a recess, a notch, a void and a gap to allow the vacuum hose to extend therethrough; and wherein the upper portion of the main body portion comprises a port operable to receive fluids and solids, and wherein the port comprises an elbow operable to receive a vacuum hose.

13. The vacuum cleaner device of claim 12, wherein the handle further comprises a holster for receiving at least one of a vacuum wand and a vacuum hose and wherein the holster is moveable between the first position and the second position.

14. The vacuum cleaner device of claim 12, further comprising a magnetic element for selectively receiving and storing an accessory.

15. The vacuum cleaner device of claim 12, wherein the storage compartment is associated with the main body portion and is selectively removable from the main body portion.

16. The vacuum cleaner device of claim 14, further comprising at least one of a vacuum head, a brush, and a tool comprising a magnetic element that is attracted to the magnetic element provided on the vacuum cleaner device.

17. The vacuum cleaner device of claim 12, wherein the storage compartment comprises a void in the main body portion.

* * * * *